US010739000B2

(12) United States Patent
Harel

(10) Patent No.: US 10,739,000 B2
(45) Date of Patent: Aug. 11, 2020

(54) POCKET LIGHTER WITH A DISPOSABLE FUEL CAN

(71) Applicant: Yigal Cohen Harel, Ratingen (DE)

(72) Inventor: Yigal Cohen Harel, Ratingen (DE)

( * ) Notice: Subject to any disclaimer, the term of this patent is extended or adjusted under 35 U.S.C. 154(b) by 50 days.

(21) Appl. No.: 15/978,372

(22) Filed: May 14, 2018

(65) Prior Publication Data

US 2019/0346136 A1 Nov. 14, 2019

(51) Int. Cl.
*F23Q 2/00* (2006.01)
*F23Q 2/167* (2006.01)
*F23Q 2/42* (2006.01)

(52) U.S. Cl.
CPC ..... *F23Q 2/167* (2013.01); *F23Q 2/42* (2013.01)

(58) Field of Classification Search
CPC ..... F23Q 2/162; F23Q 2/167
USPC ..... 431/344, 143
See application file for complete search history.

(56) References Cited

U.S. PATENT DOCUMENTS 2,675,689 A * 4/1954 Wassem et al. ..... F23Q 2/162 137/377
2,769,326 A * 11/1956 Perlin ..... F23Q 2/167 431/130
4,072,290 A * 2/1978 Neyret ..... F23Q 2/163 251/127
2004/0081931 A1* 4/2004 Sgroi, Jr. ..... F23Q 2/164 431/153
2005/0202359 A1* 9/2005 Lin ..... F23D 14/36 431/153
2009/0162803 A1* 6/2009 Ruan ..... F23Q 2/32 431/253

* cited by examiner

*Primary Examiner* — Avinash A Savani
(74) *Attorney, Agent, or Firm* — Malone IP Law; Steven J. Malone

(57) ABSTRACT

A pocket lighter with a universal disposable butane fuel can has been developed. The pocket lighter includes: a fuel can adaptor; the fuel can adaptor comprises: a first recess that accepts a ridged portion of the disposable fuel can, a through hole that accepts a gas outlet valve; the gas outlet valve comprising a second recess that accepts a depressible portion of the disposable fuel can; wherein the gas outlet valve extends through the through hole of the fuel can adaptor; and wherein the ridged portion of the disposable fuel can seals against a shoulder portion of the first recess, and the depressible portion of the disposable fuel can seals against the second recess when the disposable fuel can is installed in fuel can adaptor.

11 Claims, 13 Drawing Sheets

POCKET LIGHTER WITH A DISPOSABLE FUEL CAN

FIELD OF THE INVENTION

The present invention is related to pocket lighters with replaceable fuel.

BACKGROUND

Pocket lighters contain built-in fuel tanks. Built-in fuel tanks, due to mechanical challenges, are very small in size and allow a very small amount of butane fuel storage requiring frequent refill or disposal of the pocket lighter. Moreover, many lighter users are reluctant to refill a lighter due to a complicated refilling process. Additionally, because of a variety of different butane suppliers, butane purity, butane pressures (mixed gases) and butane quality suffer causing a negative impact on a lighters' performance. Built-in fuel tanks contain extra mechanical parts used for refilling the tanks and are common causes of lighter repair or failure.

SUMMARY

A pocket lighter with a universal disposable butane fuel can has been developed. The pocket lighter includes: a fuel can adaptor; the fuel can adaptor comprises: a first recess that accepts a ridged portion of the disposable fuel can, a through hole that accepts a gas outlet valve assembly; the gas outlet valve assembly comprising a second recess that accepts a depressible portion of the disposable fuel can; wherein the gas outlet valve assembly extends through the through hole of the fuel can adaptor; and wherein the ridged portion of the disposable fuel can seals against a shoulder portion of the first recess, and the depressible portion of the disposable fuel can seals against the second recess when the disposable fuel can is installed in fuel can adaptor. The purpose of the adaptor is to allow a universal butane can with a universal valve to be fitted into the adaptor.

The disposable fuel can may have a volumetric liquid fuel capacity between 1 milliliter and 30 milliliters. The fuel can adaptor may further comprise one or more burner hinge supports for rotating a burner unit of the pocket lighter. The gas outlet valve may further comprise a first gas regulating filter and a second gas regulating filter. The burner unit may produce a soft flame, torch flame, twin flame, circular flame, or a combination thereof. The burner unit may be a user replaceable accessory of the pocket lighter. The gas outlet valve may further comprise a gas outlet nozzle. The gas outlet nozzle may further comprise a flame adjuster. The flame adjuster may be accessible on at least two opposite sides of the pocket lighter. The first gas regulating filter and the second gas regulating filter may be both positioned between the gas outlet nozzle and the second recess. The gas outlet valve may further comprise a metal filter and a filter control ring. The pocket lighter of claim 11, wherein the first gas regulating filter and the second gas regulating filter are both positioned between the metal filter and the filter control ring. The gas outlet valve may further comprise one or more O-rings that seal the depressible portion of the disposable fuel can against an inner wall portion of the second recess when the disposable fuel can is installed in the pocket lighter. The fuel can adaptor may further comprise a support post extending parallel to the gas outlet nozzle. The support post may further comprise a hole for fixing a lever guide to the support post. The fuel can adaptor may further comprise a gas lever that attaches to the gas outlet nozzle and pivots against the lever guide. The fuel can adaptor may further comprise a flexible gas tube that connects an outlet of the gas outlet nozzle to an input of the burner unit. The first recess, the second recess may each extend in a substantially parallel direction. The base portion of the burner unit may further comprise notches for positionally fixing an angle of rotation of the burner unit. The flexible gas tube may connect to a 90-degree input fitting of the burner unit. While traveling with a lighter, the fuel can may be removed to meet specific TSA travel requirements.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings.

Figure 1:
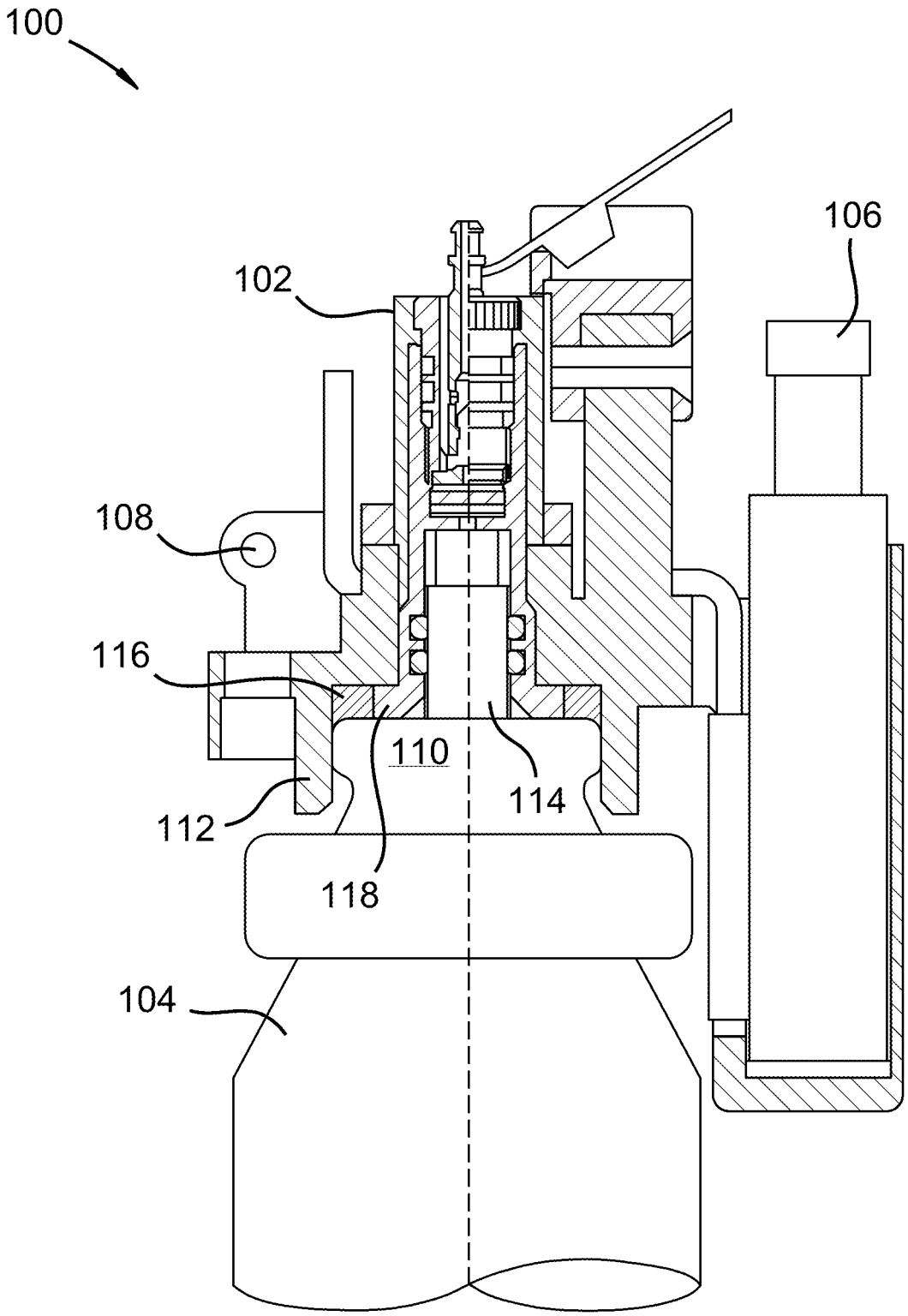
FIG. 1 is a side cross-sectional view of a fuel can adaptor in accordance with an embodiment of the invention.

FIG. 1 is a cross-sectional side view of fuel can adaptor 100. Fuel can adaptor 100 includes a piezo-electric generator 106, a gas outlet valve assembly 102, a first recess formed by wall 112, a second recess (315 of FIG. 3B) formed by wall 118 of gas outlet valve assembly 102, and one or more burner hinge supports 108 for rotating and securing a burner unit assembly (500 of FIG. 5) to the fuel can adaptor 100. Fuel can adaptor 100 is shown with a disposable fuel can 104 inserted into fuel can adaptor 100. Fuel can 104 can be separated or removed by sliding fuel can 104 away from fuel can adaptor 102. Fuel can 104 includes a ridged portion 110 and a depressible valve portion 114. Depressible valve 114 releases fuel when depressed or pressed in toward ridged portion 110. When disposable fuel can 104 is installed, valve 114 is depressed and releases pressurized fuel into fuel can adaptor 100. O-ring 116 provides a safety seal between gas outlet valve 102, ridged fuel can portion 110, and fuel can adaptor wall 112. Fuel can adaptor wall 112 forms a first recess allowing insertion of ridged fuel can portion 110 into fuel can adaptor 100. A piezo-electric generator 106 is located in an additional recess (third recess) inside of fuel can adaptor 100 and extends in a generally parallel direction with the first recess and the second recess. A second recess (315 of FIG. 3B) is formed by wall 118 of gas outlet valve assembly 102. Replacement of disposable fuel can 104 is simple and easy because of features and structure of fuel can adaptor 100 as will be described in greater detail in relation to FIGS. 2A and 2B.

Figure 2A:
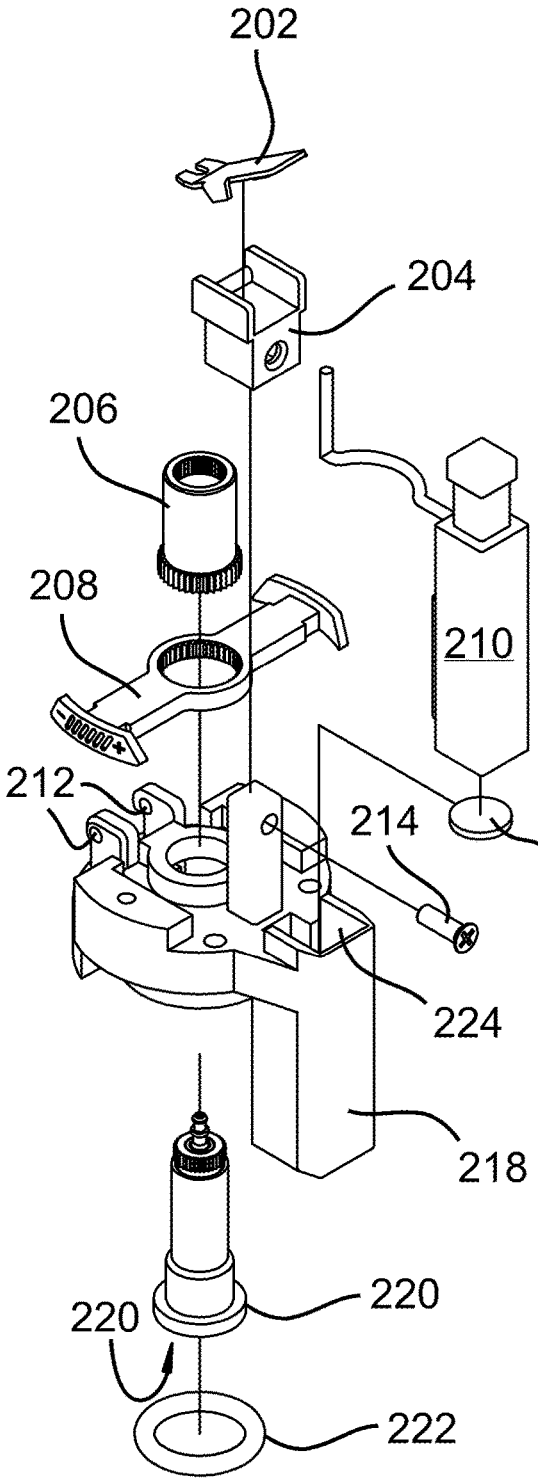
FIG. 2A is an exploded view of a fuel can adaptor in accordance with an embodiment of the invention.
Figure 2B:
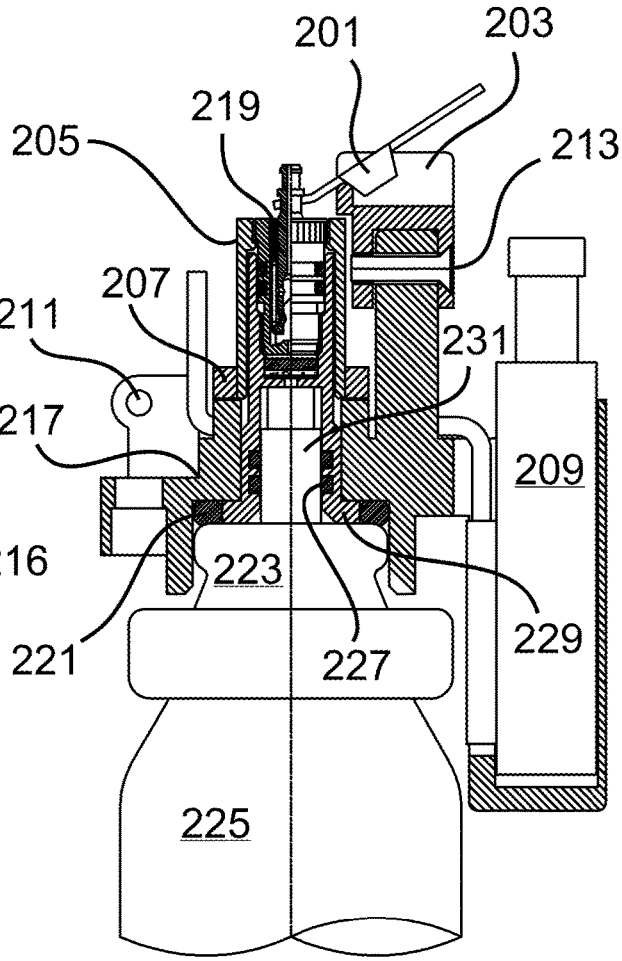
FIG. 2B is a side cross-sectional view of a fuel can adaptor in accordance with an embodiment of the invention.

FIGS. 2A and 2B show an exploded view 2A and a cross-sectional view 2B of fuel can adaptor 100 in accordance with an embodiment of the invention. The fuel can adaptor is an assembly of components and structure shown in FIGS. 2A and 2B. Gas lever 201/202 attaches to gas outlet nozzle 219 of gas valve assembly 220 and pivots against lever guide 203/204. Lever guide 203/204 is removably fixed to support post 226 by fastening means 213/214. Support post 226 extends in a substantially parallel plane to an extending plane of the gas outlet nozzle 219. Disposable/removable fuel can 225 is a very small fuel can with a volumetric liquid fuel capacity between 1 ml and 30 ml. A small fuel can is necessary to maintain a standard size of a pocket sized lighter. One or more burner hinge supports 211/212 are used to provide a rotational pivot for a burner unit assembly (500 of FIG. 5) to the fuel can adaptor. Flame adjuster 207/208 is accessible on at least two opposite sides of the pocket lighter/fuel can adaptor. Gas outlet valve 220 further comprises one or more O-rings 227 that seal the depressible valve 231 of the disposable fuel can 225 against an inner wall of the second recess when the disposable fuel can is installed in the pocket lighter/fuel can adaptor. Third recess 224 may be an integrally formed recess in a body portion 218 of fuel can adaptor 100. Piezo-electric generator 209 is positioned on top of cushion 216 inside of third recess 224. O-ring 221/222 seals against ridged portion 223 of the disposable fuel can 225, and seals against a shoulder portion of the first recess formed by structural wall element 217, and seals against gas outlet valve assembly wall 229.

Figure 3A:
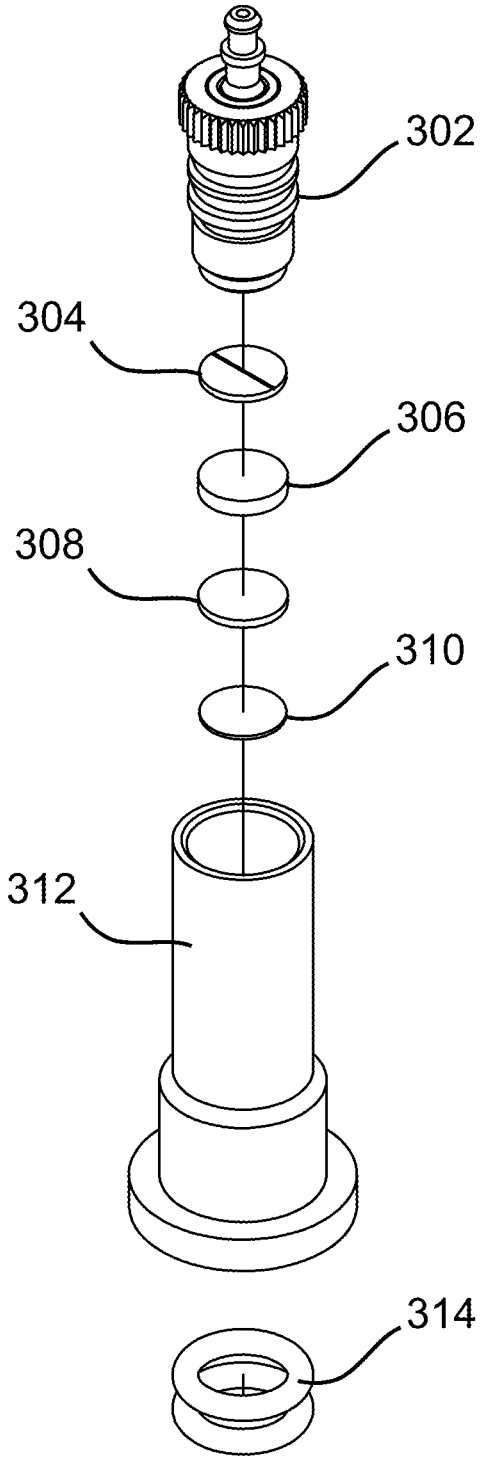
FIG. 3A is an exploded view of a gas outlet valve in accordance with an embodiment of the invention.
Figure 3B:
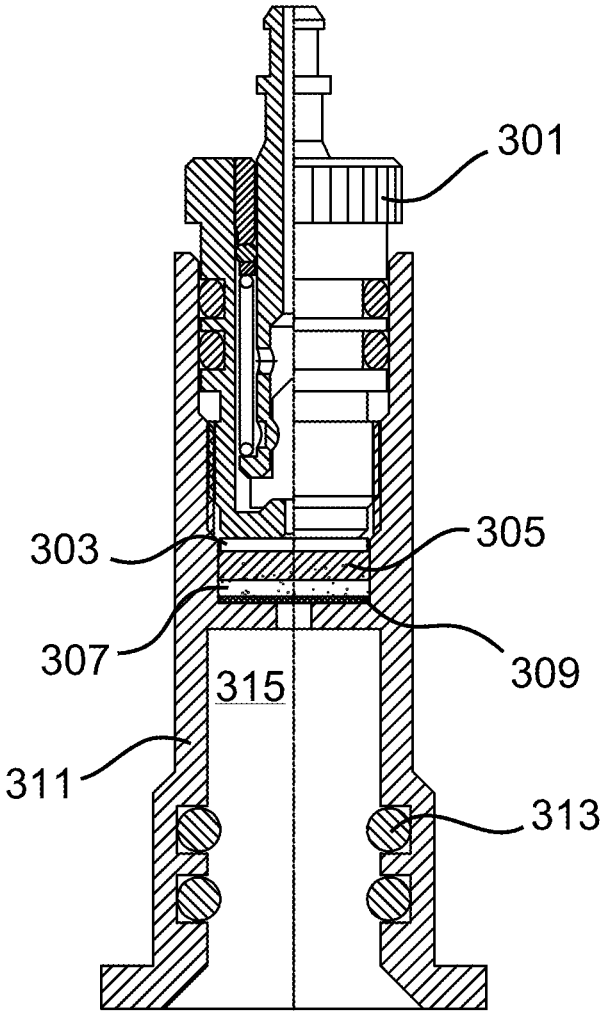
FIG. 3B is a side cross-sectional view of a gas outlet valve in accordance with an embodiment of the invention.

FIGS. 3A and 3B show an exploded view 3A and a cross-sectional side view 3B of gas outlet valve assembly 220 in accordance with an embodiment of the invention. Gas outlet valve assembly 220 includes a valve body 311/312 which forms a second recess 315 for receiving a disposable fuel can. Second recess 315 also includes one or more groves for securing one or more O-rings 313/314. Valve body 311/312 forms an upper chamber for receiving gas outlet nozzle 301/302 and a lower chamber (second recess) for receiving a disposable fuel can. An orifice connects the upper chamber to the lower chamber because of the integrally formed valve body structure 311/312. Gas outlet nozzle 301/302 includes a flame adjuster 208 for increasing gas pressure and/or gas volume through outlet nozzle 301/302. Directly below gas outlet nozzle 301/302 is a filter control ring 304, second gas regulating filter 306, first gas regulating filter 308, and metal filter 310. Filter control ring 304 is used to set gas pressure and/or gas volume before the fuel enters the gas outlet nozzle. First and second gas regulating filters 306/308 are used to stabilize temperature and pressure of liquid and/or gas fuel. Metal filter 310 helps to volatilize (warm up, spread out) liquid and/or gas fuel from the disposable fuel can. Metal filter 310, first and second gas regulating filters 306/308, and filter control ring 304 may be made with porous materials, composite materials, metering orifices, heat conducting materials or combinations thereof.

Figure 4:
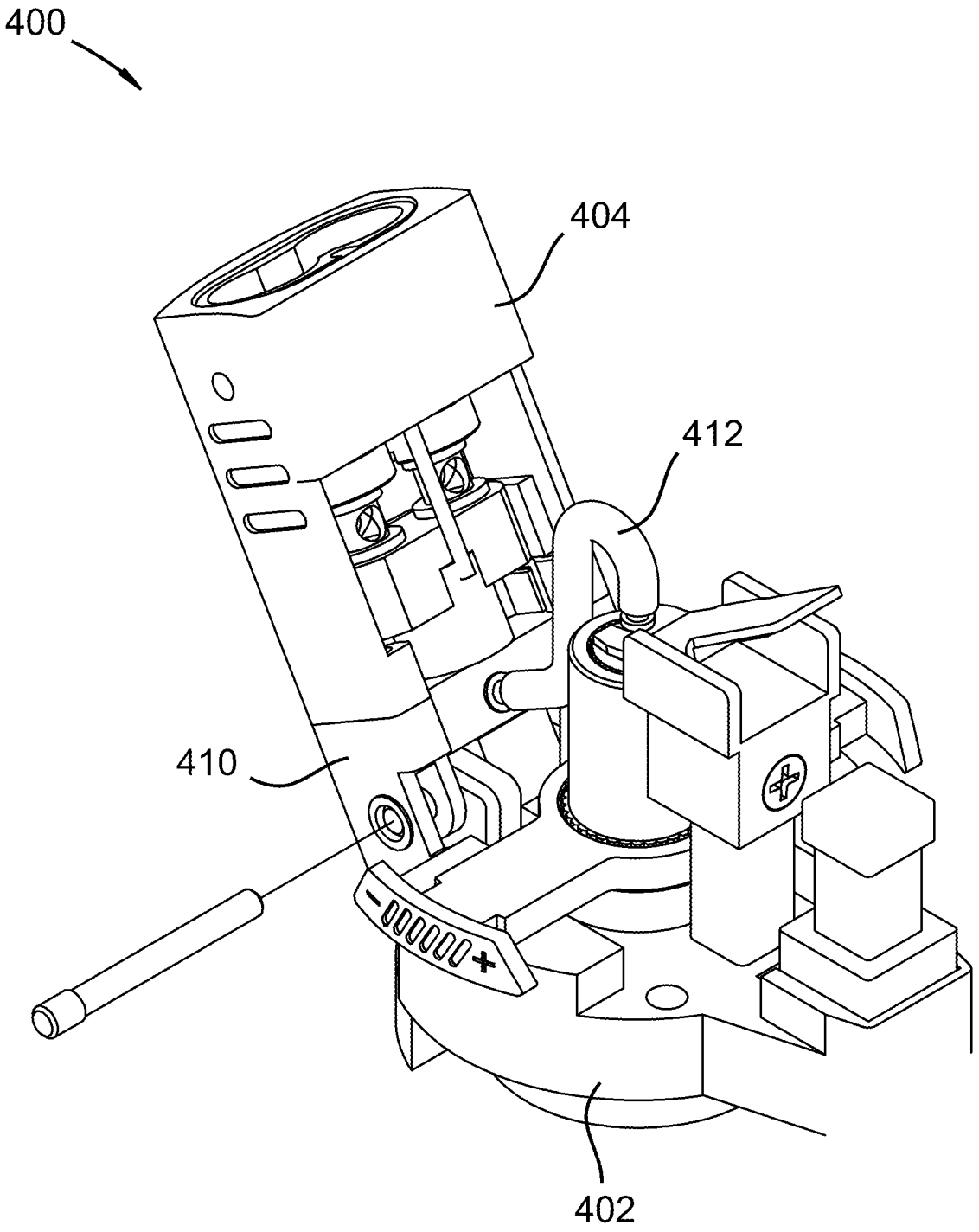
FIG. 4 is a perspective view of a fuel can adaptor and burner unit in accordance with an embodiment of the invention.

FIG. 4 is a perspective view of a fuel can adaptor 400 and burner unit assembly 404/410 in accordance with an embodiment of the invention. Burner unit assembly 404/410 comprises a burner holder unit 410 and a jet burner unit 404. Burner holder unit 410 is connected to a main body portion 402 of fuel can adaptor 400 by a hinge pin allowing rotational movement of burner assembly 404/410. Flexible gas tube 412 connects an outlet of gas outlet nozzle to an input of the burner holder unit 410. Flexible gas tube 412 allows burner holder unit 410 to rotate about an axis formed by the mounting hinge pin while still supplying fuel to the top burner unit 404.

Figure 5:
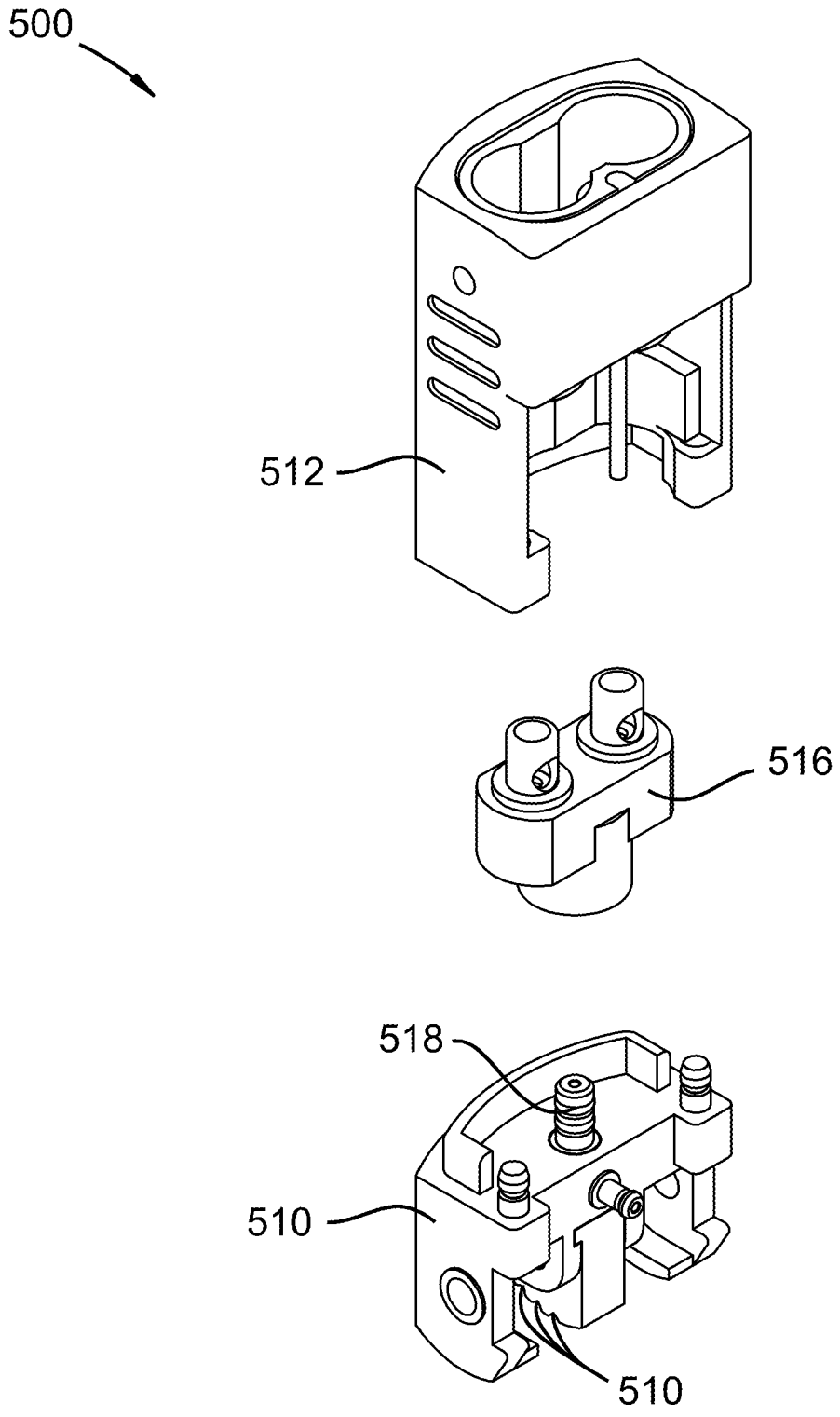
FIG. 5 is an exploded perspective view of a burner unit assembly in accordance with an embodiment of the invention.

FIG. 5 is an exploded perspective view of a burner unit assembly 500 in accordance with an embodiment of the invention. Burner unit assembly 500 includes a jet burner unit 512, an injection burner unit 516, and a burner holder unit 510. Burner holder unit 510 includes one or more notches 510 for positionally fixing an angle of rotation of the burner unit assembly 500. Injection burner unit 516 snaps over angle fitting 518 allowing the jet burner and injection burner unit to be replaced by a user without any tools.

Figure 6A:
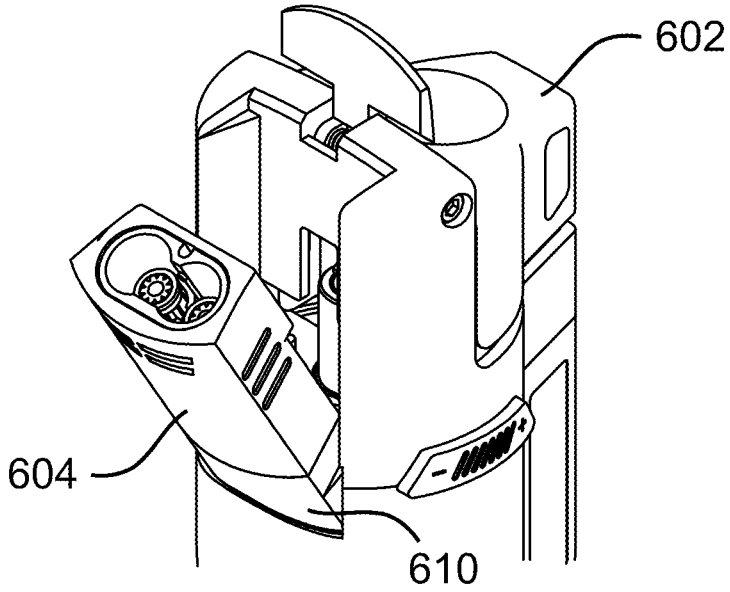
FIG. 6A shows a perspective view of a pocket lighter top portion with a rotating burner in accordance with an embodiment of the invention.

FIG. 6A shows a perspective view of a pocket lighter 602 with an installed jet burner unit 604 in accordance with an embodiment of the invention.

Figure 6B:
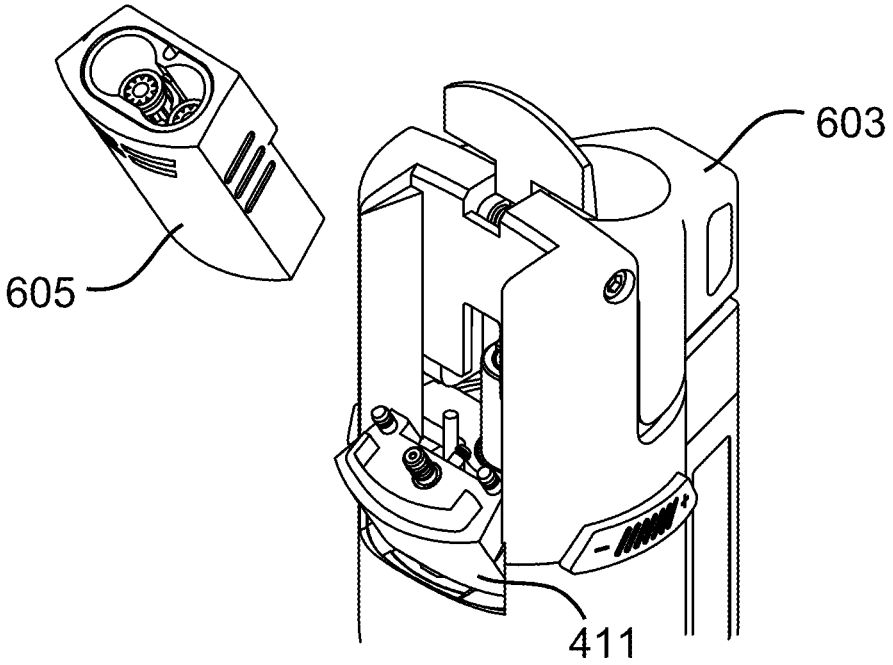
FIG. 6B shows a perspective view of a pocket lighter top portion with a removable burner portion in accordance with an embodiment of the invention.

FIG. 6B shows a perspective view of a pocket lighter 603 with a removed (snapped out) jet burner unit 605 in accordance with an embodiment of the invention. Various types of burners and flame configurations may be used with lighters 602/603 and switch as needed for application type and user preference.

Figure 7:
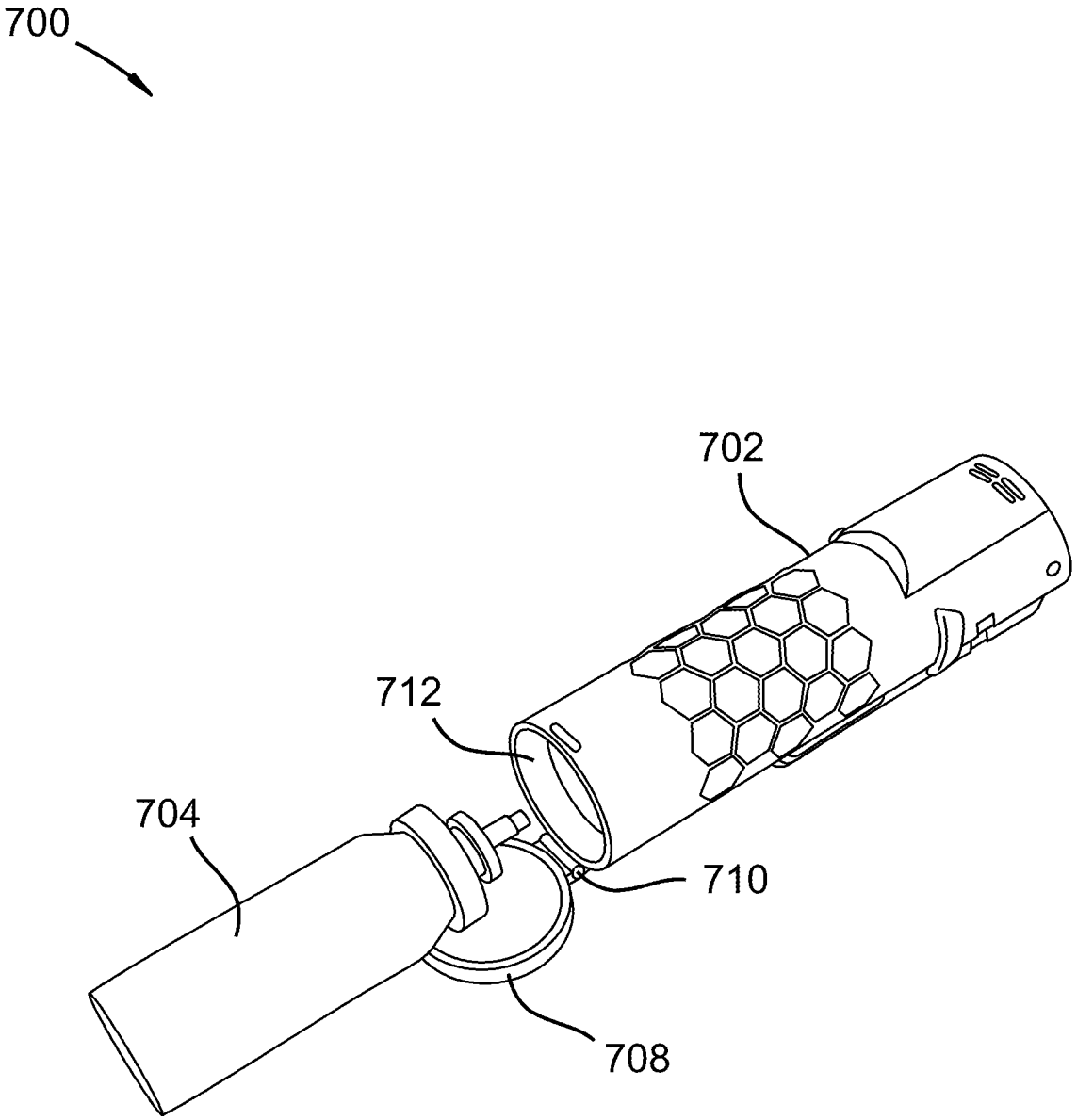
FIG. 7 shows a perspective view of a pocket lighter with a disposable fuel can in accordance with an embodiment of the invention.

FIG. 7 shows a perspective view of a pocket lighter 700 with a disposable fuel can 704 in accordance with an embodiment of the invention. Lighter body 702 includes an opening 712 for receiving a disposable fuel can 704. Disposable fuel can 704 is secured inside of lighter body 702 by means of door 708, hinge 710, and/or a door 708 locking mechanism.

Figure 8:
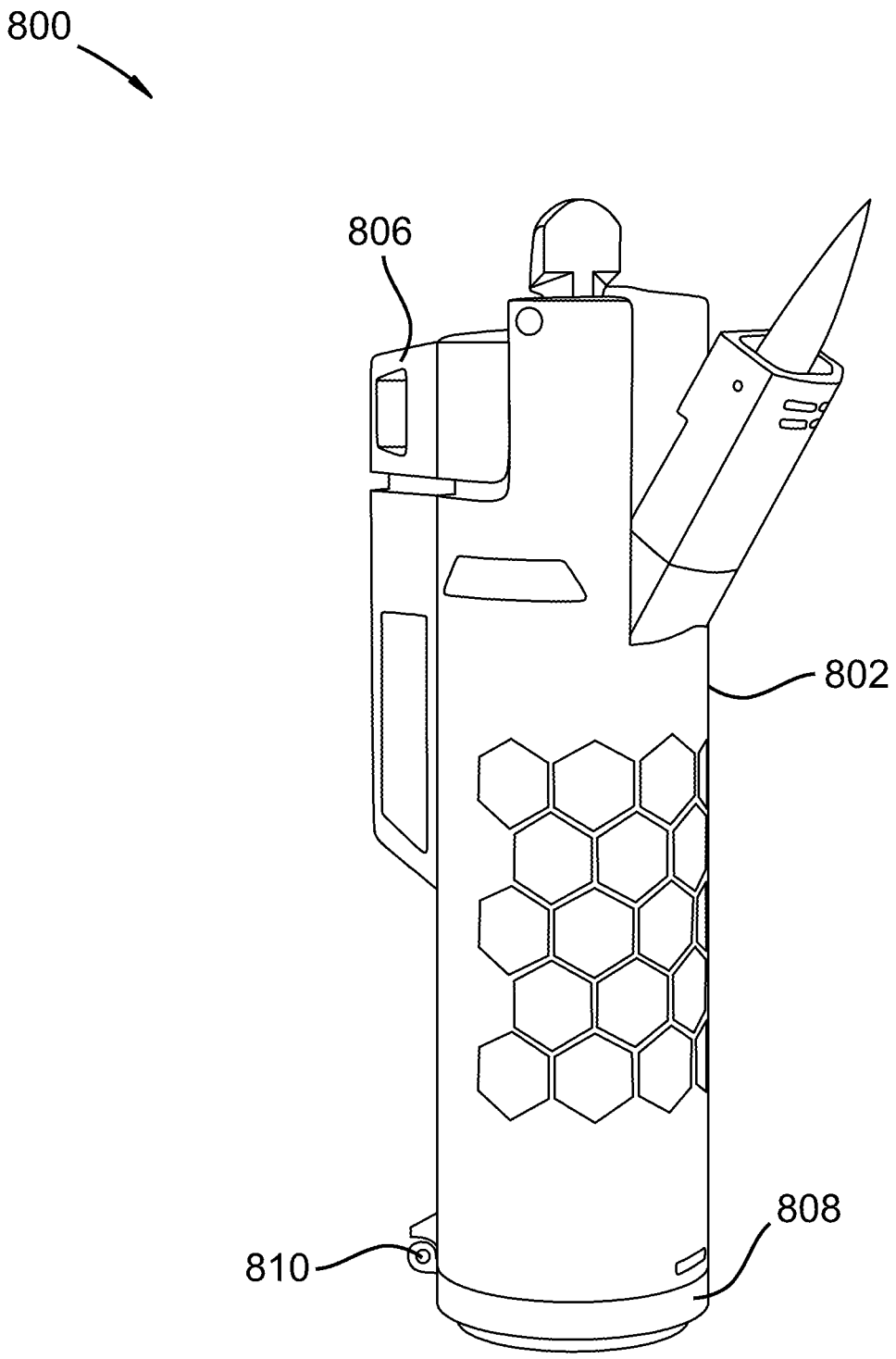
FIG. 8 shows a perspective view of a pocket lighter in accordance with an embodiment of the invention.

FIG. 8 shows a perspective view of a pocket lighter 800 in accordance with an embodiment of the invention. Pocket lighter 800 is lit as a user depresses light actuator 806 activating, simultaneously, the gas lever and the piezoelectric generator causing ignition of fuel through the burner. Door 808 and hinge 810 provides access to a disposable fuel can within lighter 800.

Figure 9:
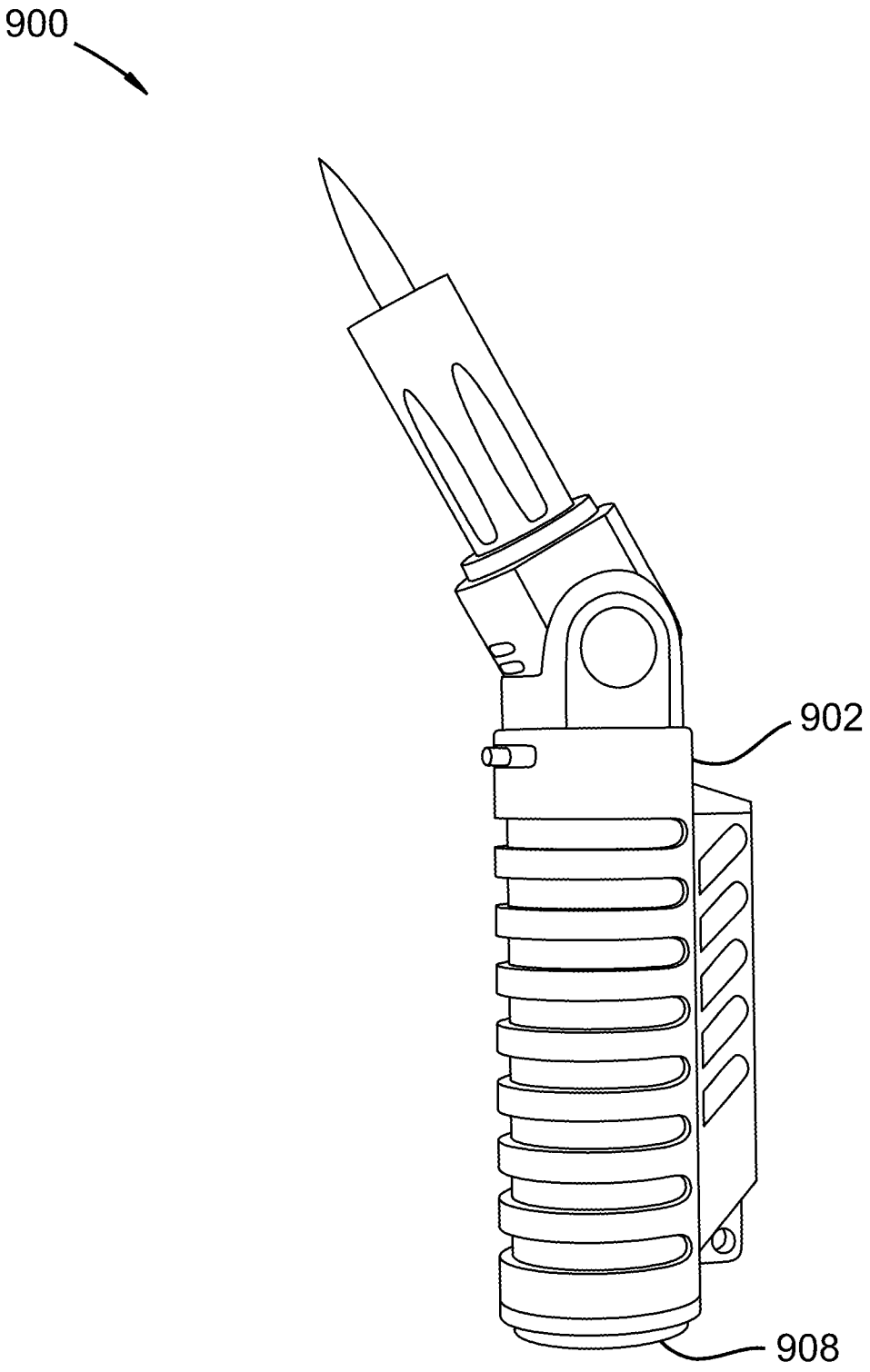
FIG. 9 shows a perspective view of a pocket lighter in accordance with an embodiment of the invention.

FIG. 9 shows a perspective view of a pocket lighter in accordance with an embodiment of the invention. Pocket lighter 900 is lit as a user depresses light actuator 902 activating, simultaneously, the gas lever and the piezoelectric generator causing ignition of fuel through the burner. Door 908 provides access to a disposable fuel can within lighter 900.

Figure 10A:
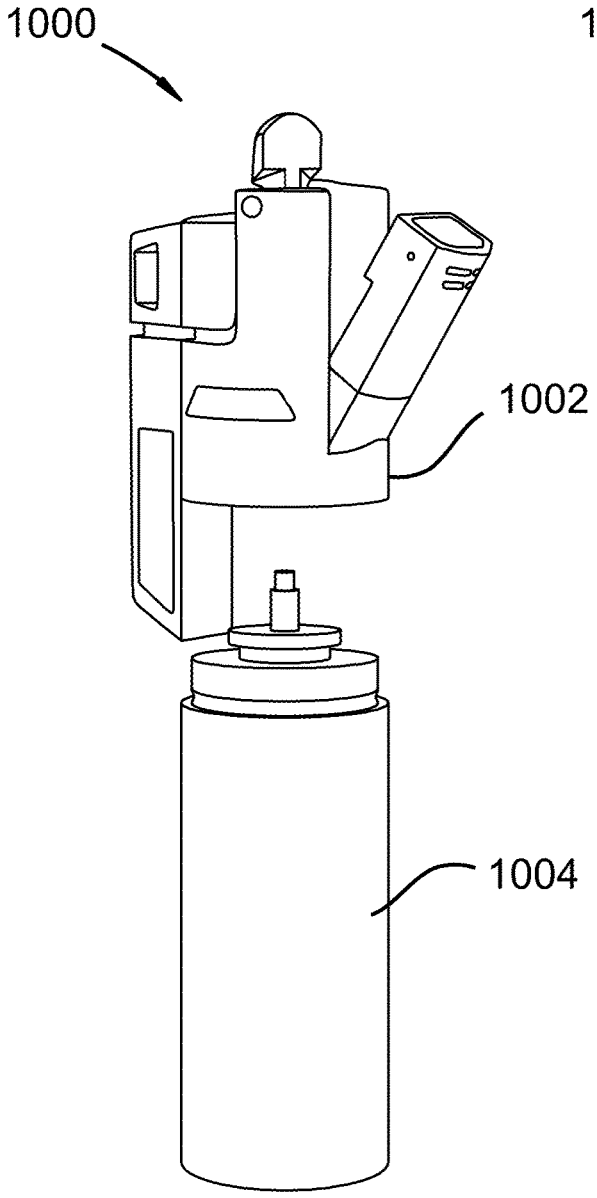
FIG. 10A shows a perspective view of a pocket lighter with a disconnected fuel can in accordance with an embodiment of the invention.
Figure 10B:
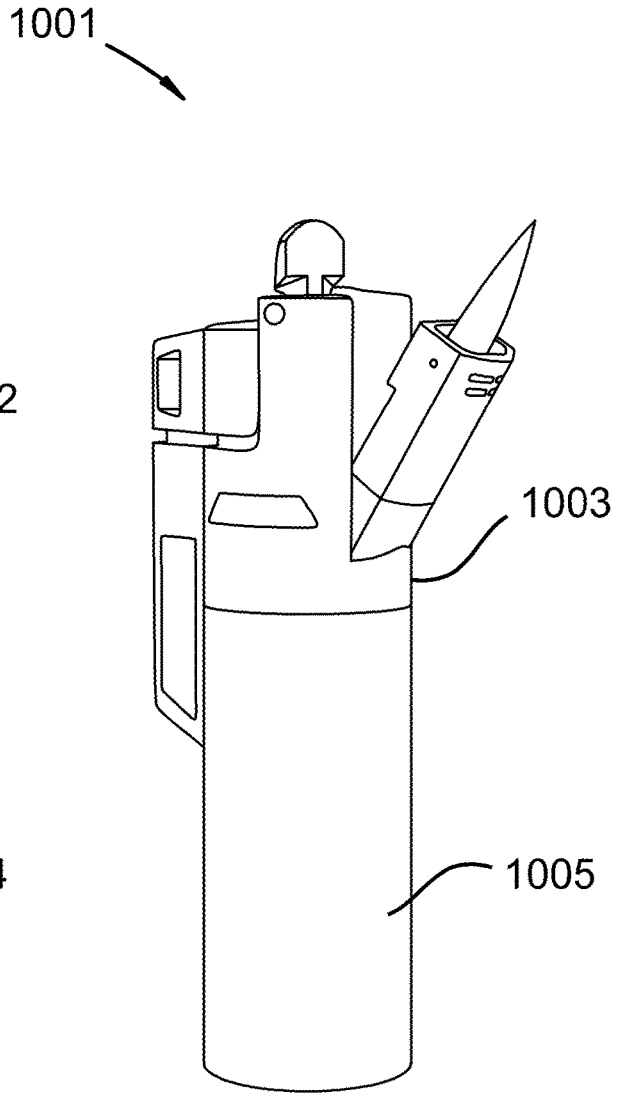
FIG. 10B shows a perspective view of a pocket lighter with an attached fuel can in accordance with an embodiment of the invention.

FIGS. 10A and 10B show perspective views of a pocket lighters 1000/1001 with a disconnected and connected fuel cans 1004/1005. In some embodiments, the fuel can may provide a body function of lighter 1000/1001 allowing a user to customize their lighter by purchasing different colors, designs and shapes of fuel cans 1004/1005. Disposable fuel can 1004 may be pressed, snapped, or screwed into fuel adaptor assembly 1002/1003 to form lighter 1001.

Figure 11A:
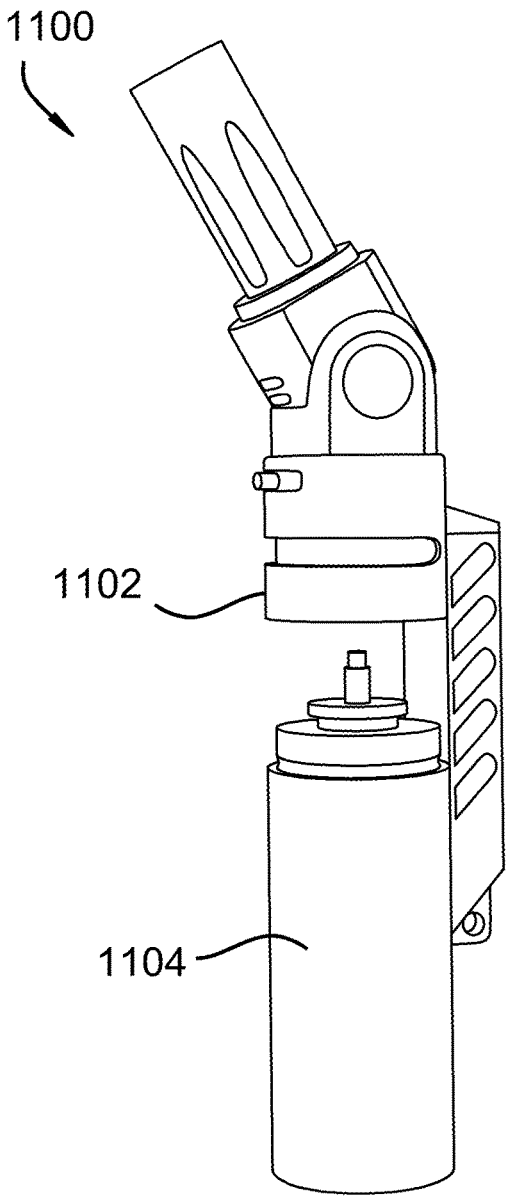
FIG. 11A shows a perspective view of a pocket lighter with a disconnected fuel can in accordance with an embodiment of the invention.
Figure 11B:
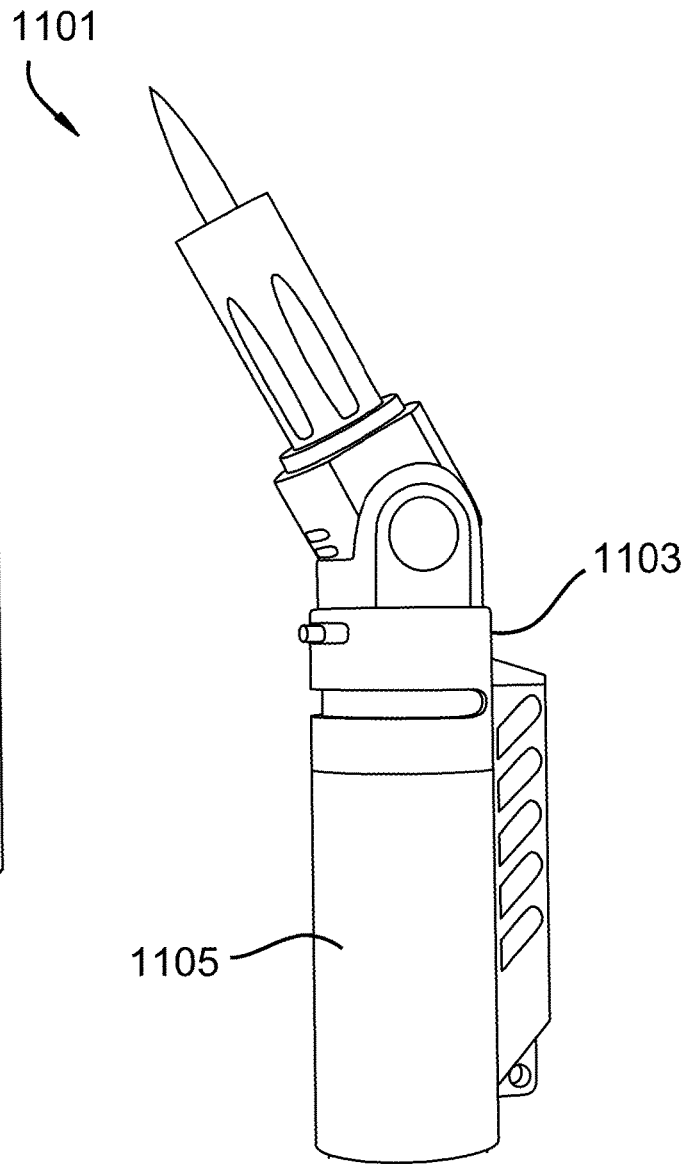
FIG. 11B shows a perspective view of a pocket lighter with an attached fuel can in accordance with an embodiment of the invention.

FIGS. 11A and 11B show perspective views of a pocket lighters 1100/1101 with a disconnected and connected fuel cans 1104/1105. In some embodiments, the fuel can may provide a body function of lighter 1100/1101 allowing a user to customize their lighter by purchasing different colors, designs and shapes of fuel cans 1104/1105. Disposable fuel can 1104 may be pressed, snapped, or screwed into fuel adaptor assembly 1102/1103 to form lighter 1101.

Figure 12:
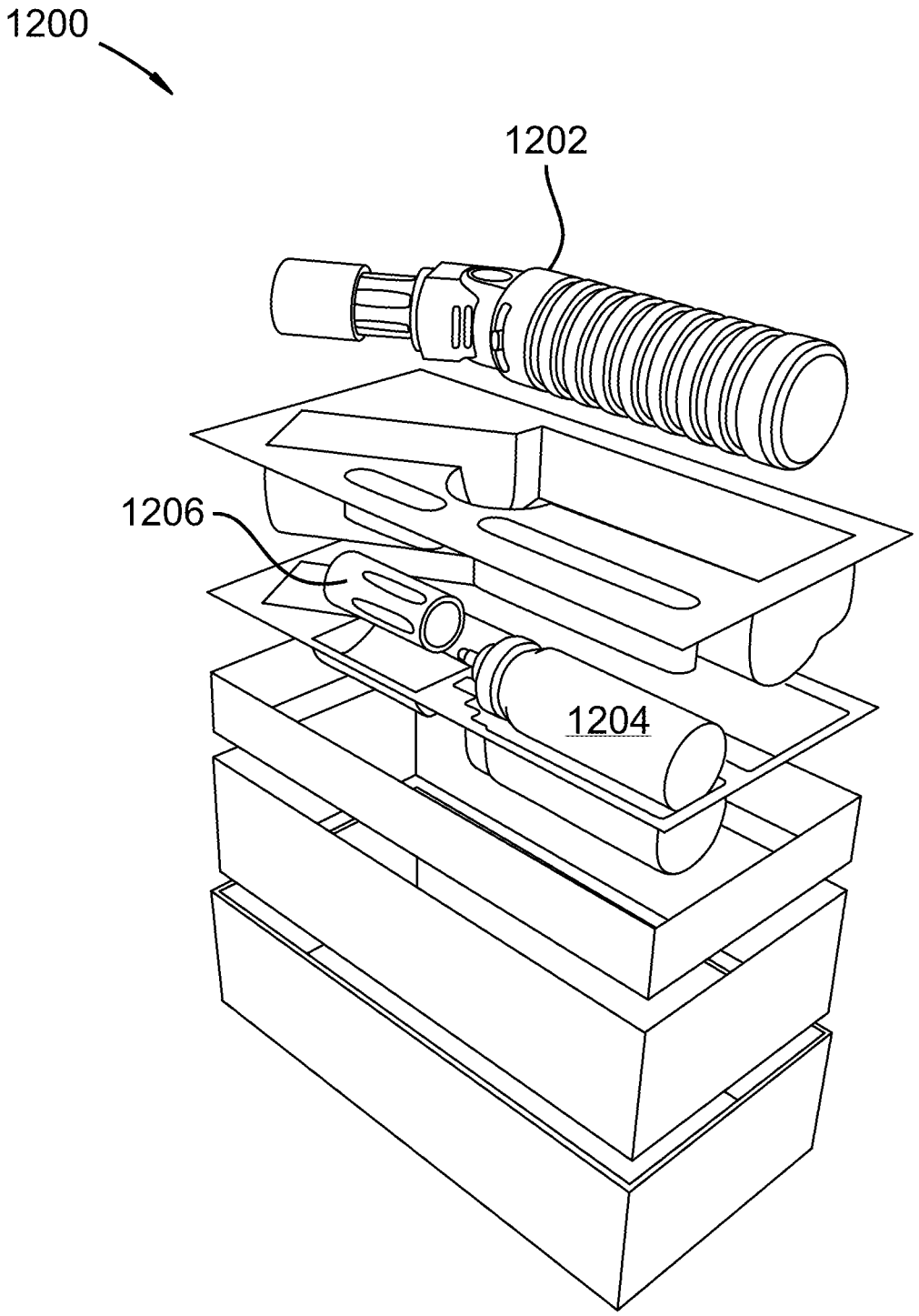
FIG. 12 shows a perspective view of a shipping assembly in accordance with an embodiment of the invention.

FIG. 12 shows a perspective view of a shipping assembly 1200 in accordance with an embodiment of the invention. Shipping assembly 1200 includes a pocket lighter 1202, a spare burner assembly 1206, and a spare fuel can 1204. Spare burner assembly 1206 and spare fuel can 1204 may easily be replaced by a user of lighter 1202 without the use of any tools and in a matter of seconds. A specific type of burner assembly 1206 may use fuel faster than another burner assembly because of the type of flame produced by the burner assembly. Accordingly, a specific type of fuel and/or fuel can 1204 may be recommended for use with a specific type of burner assembly because of fuel type and/or fuel quantity and/or fuel quality.

Figure 13A:
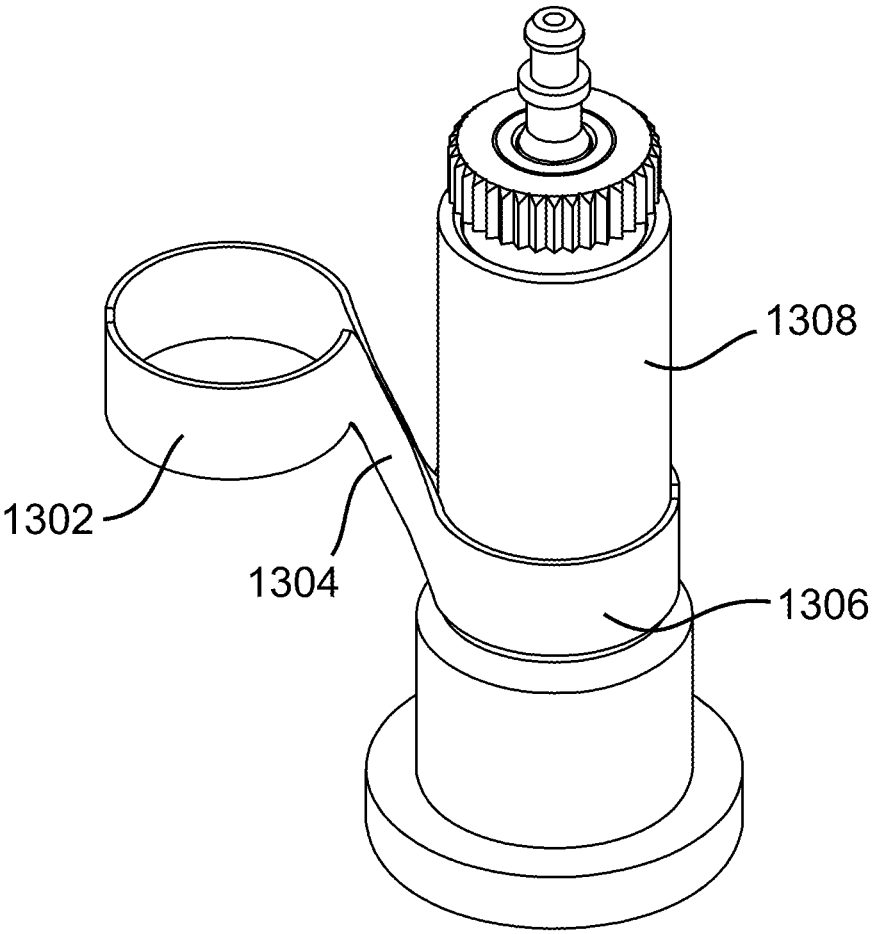
FIGS. 13A and 13B show heat transfer wire(s) connected to a gas outlet valve assembly 13A and a heat transfer wire 13B in accordance with an embodiment of the invention.
Figure 13B:
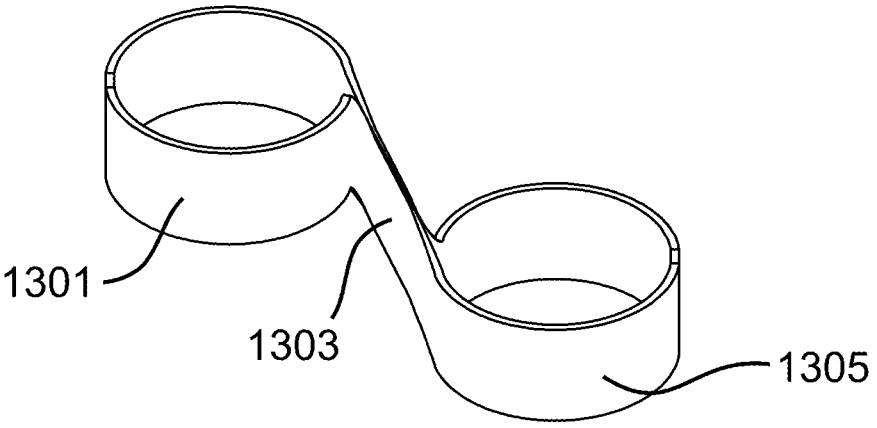

FIGS. 13A and 13B show a heat transfer wire(s) connected to a gas outlet valve assembly 13A and a heat transfer wire 13B in accordance with an embodiment of the invention. Heat transfer wire(s) 1301/1302, 1303/1304, 1305/1306 conduct heat to gas outlet valve 1308. The transferred heat may be ambient heat, heat generated by a hand of a lighter user, heat generated by a burner unit of a lighter, or a combination thereof. In FIG. 3A, wire portion 1304 may be used as a spring to mechanically move a burner unit by spring force while also conducting heat to gas outlet valve 1308. Gas outlet valve 1308 will start to internally cool as liquid fuel expands within outlet valve 1308. Heat transfer wire(s) 1301/1302, 1303/1304, 1305/1306 may be used to warm up outlet valve 1308 and enable fast volatilization/vaporization of fuel entering output valve 1308. Heat transfer wire(s) may comprise multiple wires or metal straps fused together forming a composite metallic band heat transfer wire or strap.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A pocket lighter with a disposable fuel can comprising:

a fuel can adaptor; the fuel can adaptor comprising: a first recess that accepts a ridged portion of the disposable fuel can and a through hole that accepts a gas outlet valve assembly;

the gas outlet valve assembly comprising a second recess that accepts a depressible valve of the disposable fuel can;

wherein the disposable fuel can has a volumetric liquid fuel capacity between 1 milliliter and 30 milliliters;

wherein the fuel can adaptor further comprises one or more burner hinge supports for rotating a burner unit of the pocket lighter;

wherein the gas outlet valve assembly further comprises a first gas regulating filter and a second gas regulating filter;

wherein the burner unit produces a soft flame, torch flame, twin flame, circular flame, or a combination thereof;

wherein the gas outlet valve assembly further comprises a gas outlet nozzle;

wherein the gas outlet nozzle further comprises a flame adjuster;

wherein the flame adjuster is accessible on at least two opposite sides of the pocket lighter;

wherein the first gas regulating filter and the second gas regulating filter are both positioned between the gas outlet nozzle and the second recess;

wherein the gas outlet valve assembly extends through the through hole of the fuel can adaptor;

wherein the ridged portion of the disposable fuel can seals against a shoulder portion of the first recess and the depressible portion of the disposable fuel can seals against the second recess as the disposable fuel can is installed in the fuel can adaptor; and wherein the first recess and the second recess each extend in a substantially parallel direction.

2. The pocket lighter of claim 1, wherein the burner unit is a user replaceable accessory of the pocket lighter.

3. The pocket lighter of claim 1, wherein the gas outlet valve further comprises a metal filter and a filter control ring.

4. The pocket lighter of claim 3, wherein the first gas regulating filter and the second gas regulating filter are both positioned between the metal filter and the filter control ring.

5. The pocket lighter of claim 4, wherein the gas outlet valve further comprises one or more O-rings that seals the depressible valve of the disposable fuel can against an inner wall of the second recess when the disposable fuel can is installed in the pocket lighter.

6. The pocket lighter of claim 5, wherein the fuel can adaptor further comprises a support post extending parallel to the gas outlet nozzle.

7. The pocket lighter of claim 6, wherein the support post further comprises a hole for fixing a lever guide to the support post.

8. The pocket lighter of claim 7, wherein the fuel can adaptor further comprises a gas lever that attaches to the gas outlet nozzle and pivots against the lever guide.

9. The pocket lighter of claim 7, wherein the fuel can adaptor further comprises a flexible gas tube that connects an outlet of the gas outlet nozzle to an input of the burner unit.

10. The pocket lighter of claim 9, wherein a base portion of the burner unit further comprises one or more notches for positionally fixing an angle of rotation of the burner unit.

11. The pocket lighter of claim 10, wherein the flexible gas tube connects to a 90-degree input fitting of the burner unit.

* * * * *